US008381646B2

(12) United States Patent
Catelli

(10) Patent No.: US 8,381,646 B2
(45) Date of Patent: Feb. 26, 2013

(54) SUPPORT APPARATUS FOR EMBOSSING ROLLS AND METHOD FOR THE REPLACEMENT OF THE SAME

(75) Inventor: Paolo Catelli, Lucca (IT)

(73) Assignee: Futura S.p.A., Frazione Guamo (IT)

( * ) Notice: Subject to any disclaimer, the term of this patent is extended or adjusted under 35 U.S.C. 154(b) by 826 days.

(21) Appl. No.: 11/569,092

(22) PCT Filed: Apr. 19, 2005

(86) PCT No.: PCT/IT2005/000222

§ 371 (c)(1),
(2), (4) Date: Nov. 14, 2006

(87) PCT Pub. No.: WO2005/123374

PCT Pub. Date: Dec. 29, 2005

(65) Prior Publication Data

US 2008/0229958 A1 Sep. 25, 2008

(30) Foreign Application Priority Data

Jun. 18, 2004 (IT) ..... FI2004A0139

(51) Int. Cl.
*B41F 19/02* (2006.01)
*B31F 1/07* (2006.01)
*B44B 5/00* (2006.01)

(52) U.S. Cl. ..... 101/23; 101/6

(58) Field of Classification Search ..... 101/23, 101/22, 28, 32, 6, 5, 4, 3.1; 156/209, 553, 156/582, 555; 425/194, 188; 162/362; 384/436, 384/437

See application file for complete search history.

(56) References Cited

U.S. PATENT DOCUMENTS

| | | | | |
|---|---|---|---|---|
| 3,039,387 | A * | 6/1962 | Zimmer et al. | 101/216 |
| 3,578,766 | A * | 5/1971 | Diolot | 101/23 |
| 4,308,796 | A * | 1/1982 | Satterwhite | 101/143 |
| 5,092,240 | A | 3/1992 | Schumacher et al. | |
| 5,647,275 | A | 7/1997 | Lupa et al. | |
| 5,669,302 | A * | 9/1997 | Rogge et al. | 101/216 |
| 6,176,287 | B1 | 1/2001 | Weber | |
| 7,481,643 | B2 * | 1/2009 | Catelli | 425/181 |
| 2005/0257894 | A1 * | 11/2005 | Biagiotti | 156/553 |

FOREIGN PATENT DOCUMENTS

| | | |
|---|---|---|
| DE | 19 22 274 A1 | 11/1970 |
| EP | 0492102 | 7/1992 |
| IT | WO 99/41064 | 8/1999 |

* cited by examiner

*Primary Examiner* — Ren Yan
*Assistant Examiner* — Leo T Hinze
(74) *Attorney, Agent, or Firm* — McGlew and Tuttle, P.C.

(57) ABSTRACT

Support apparatus for embossing rolls comprising a fixed structure (1) with two sides (10), which provide multiple supports for one or more embossing rolls (2) having the respective horizontal axes between said sides (10) and being connected with corresponding motors (45) which make the rolls rotate around the respective axes at a preset angular velocity, characterized in that each of said supports is of the collar type (3) coaxial with and external to the axis of the respective embossing roll (2) and made by two elements (30, 31), one (30) being fixed and the other one (31) mobile, the mobile element (31) realizing the closing and, respectively, the opening of the collar (3) around the axis of the embossing roll (2) by means of an actuator (4; 62) controlled by a corresponding control device.

7 Claims, 16 Drawing Sheets

SUPPORT APPARATUS FOR EMBOSSING ROLLS AND METHOD FOR THE REPLACEMENT OF THE SAME

The present invention relates to a support apparatus for embossing rolls and a method for the replacement of the same.

It is known that embossing is a mechanical procedure to impart multiple patterns onto yielding materials, for example, onto webs or plies of paper. To this end, the material to be embossed is moved through a calender comprising a steel roll exhibiting substantially punctiform protuberances and an opposed smooth rubber roll. The steel roll is connected to respective handling means, whereas the rubber roll is idle on the respective support axis. The embossing results from the passage of the material between the rolls of the calender where the material is pressed, but not perforated, in correspondence of the protuberances on the steel roll. Such operation is usually applied to multiple different plies, intended to be glued together and wound into logs by rewinding machines.

It is also known that the embossing effect on paper plies is strictly dependent on the peripheral characteristic of the embossing rolls, that is on the disposition and dimensions of said protuberances. Embossing rolls often exhibit designs or patterns and may need to be replaced frequently, even daily, in order to change designs or patterns on the paper material to be embossed.

The following three techniques are applied in order to change the type of embossing according to specific production needs:

- the construction of a machine equipped with two or three embossing rolls having different peripheral characteristics and operated alternately;
- the use of an embossing roll consisting of a smooth cylinder with a removable roll liner fitted thereon and provided with substantially punctiform protuberances to be replaced every time a different embossing effect is needed;
- the removal of the embossing roll and replacement thereof with another roll provided with protuberances differing in shape and/or size.

In the first case, an inconvenience lies in that the changes in embossing are limited by the reduced number (two or three) of alternating rolls. Moreover, given the mechanical complexity of the alternating device for the rolls, in the case of a double embosser, said alternation is not possible for both rolls, but only for one. In addition, this system is particularly expensive and requires the pre-embossment of the plies of paper.

In the second case, the inconveniences related to the mechanical complexity and construction costs are even more pronounced because it is necessary to use special equipment to release and completely extract the roll liner; it is also necessary to repeat the same operations, in reverse order, to mount a new liner. Usually, at least thirty minutes, during which the production is interrupted, are required to execute these operations.

The third technique does not require special equipment and allows the use of an almost unlimited number of embossing rolls with protuberances differing in shape and/or size.

However, in this case, the inconvenience lies in that the time necessary for the replacement of the rolls is elevated and, in any case, incompatible with nowadays production standards. Moreover, it is necessary to employ specialized personnel for the disassembly and reassembly of the mechanical components connected to the embossing rolls.

Usually, for the replacement of each roll it is necessary to disconnect the transmission members (belts, joints, reducers, etc.) from the embossing rolls, disassemble all other mechanical components in order to free the side of the machine where the roll must be extracted, support the roll with appropriate lifting means and remove the supports of the roll from both the machine sides. As stated above, these operations, in addition to being time consuming, also require the employment of specialized personnel because all relevant mechanical components must be disassembled or removed and then reassembled with extreme precision and expertise. U.S. Pat. No. 6,176,287 discloses a support apparatus for embossing rolls comprising collar-type supports for each embossing roll.

EP 492102 discloses automatically operable collartype supports for printing rollers in a printing machine.

The main objective of the present invention is to propose a support apparatus for embossing rolls which allows to replace the embossing rolls more quickly and efficiently.

Another objective of the present invention is to propose a support apparatus for embossing rolls which allows the replacement of the rolls to be operated by the same personnel in charge of operating the machine, without the intervention of specialized personnel.

This result has been achieved, according to the present invention, by adopting the idea of creating an apparatus and a method having the characteristics disclosed in the independent claims. Further characteristics of the invention are dealt with in the dependent claims.

Thanks to the present invention it is possible to noticeably reduce the time necessary for the replacement of the embossing rolls. Moreover, the replacement of such rolls may be operated by the personnel normally in charge of operating the machine, without having to employ specialized personnel. In addition, a support apparatus for embossing rolls, according to the invention, is relatively easy to make and automatize, cost-effective and reliable even after extensive use.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
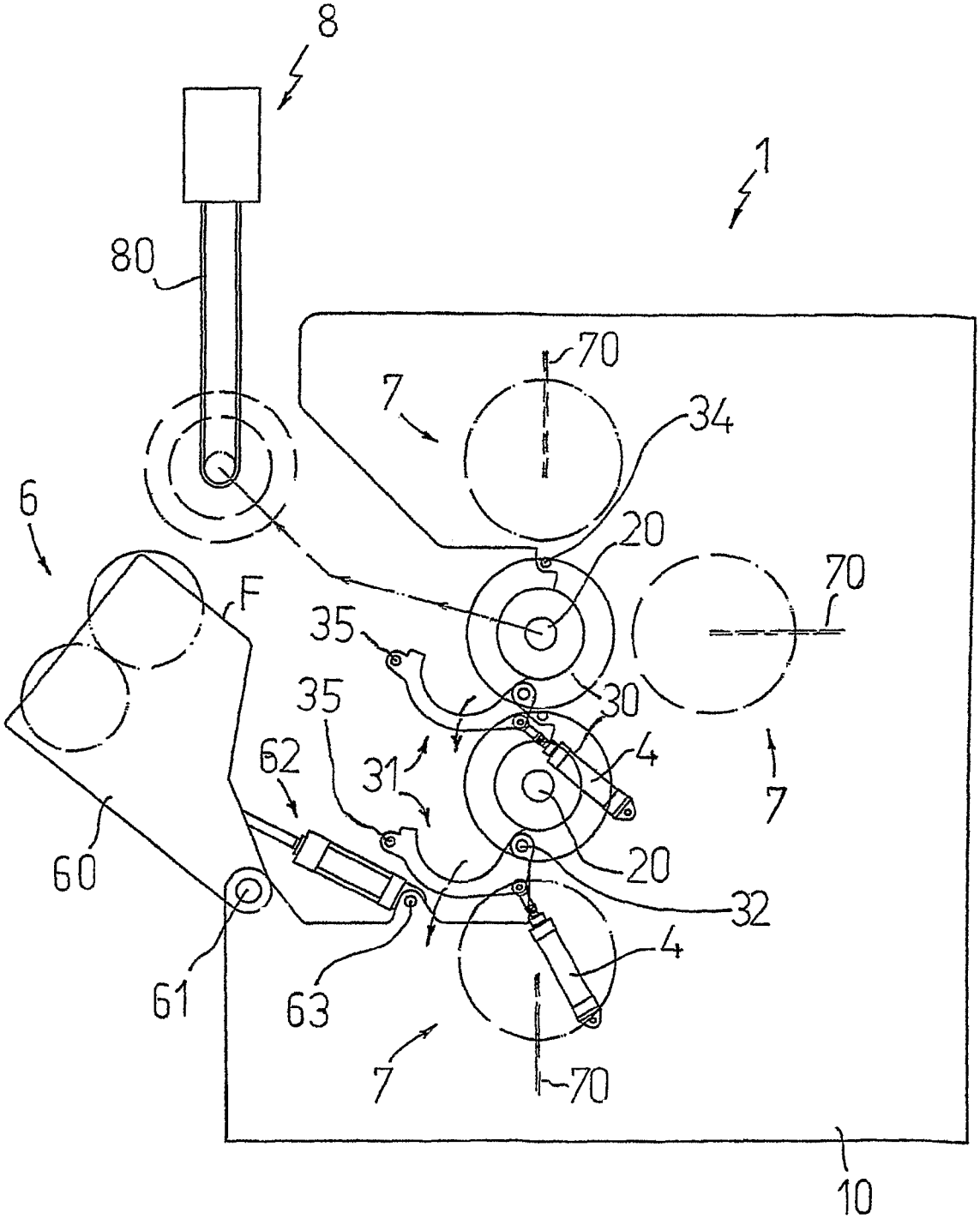
FIG. 1 is a simplified side view from the operator side of an apparatus according to the present invention, in the position for the possible replacement of two embossing rolls.

Reduced to its basic structure and with reference being made to the examples in FIGS. 1-8 in the attached drawings, a support apparatus for embossing rolls, according to the invention, comprises a fixed structure (1) with two sides (10) supporting the end portions (20, 21) of two embossing rolls (2). The latter are mounted with their respective horizontal axes between the two sides (10) and with each said end portion (20, 21) positioned in corresponding bearing seats (3).

Located on each said side (10), each bearing is of the collar type and is coaxial with and external to the axis of the respective embossing roll (2). Said collar (3) is made of two elements (30, 31), one of which (30) is fixed, that is integral with the respective side (10) or made by a portion of the same side, whereas the other element (31) is mobile, being connected to the fixed element (30) by means of a corresponding hinge (32) with horizontal axis, that is with the axis parallel to the rotation axis of the embossing rolls (2), and being connected with a respective actuator (4). The latter may be, for example, a pneumatic cylinder. The skirt of said actuator. (4) is solid to the respective side (10) of the structure (1), the rod of the same actuator being hooked to the mobile element (31) of the collar (3). The retraction of the rod of the actuator (4) causes the mobile element (31) of the bearing to rotate (counter-clockwise, in FIG. 1) around the axis of the relative hinge (32), that is the opening of the collar and the ensuing release of the corresponding end portion (20, 21) of the respective embossing roll (2). Vice versa, the extension of said rod causes the mobile element (31) to rotate in the opposite direction (clockwise, when the previous is counter-clockwise), that is the closing of the collar (3) around the corresponding end portion (20, 21) of the respective embossing roll. When the collars (3) are in the closed position, that is in the operating position, the fixed part (30) and the mobile part (31) of each collar (3) are fastened to each other by means of a pin (33) passing through two corresponding holes (34, 35) provided on said fixed part (30) and, respectively, on said mobile part (31). Each one of said pins (33) is located at the end of the rod of a corresponding actuator (36), for example, a pneumatic cylinder, supported by a panel (11), which is parallel and external to the respective side (10) of the structure (1), and positioned parallel to the axis of the embossing rolls (2).

Each embossing roll (2) is connected with a motor (45) by means of a transmission comprising an axial clutch (40), which may be inserted and, respectively, disconnected by means of a respective pneumatic actuator (41). In more detail, each clutch (40) is made of a grooved body with predominant longitudinal development (for example, a grooved bar) coaxial with a corresponding embossing roll (2) and passing through a correspondingly grooved bushing (42). The latter is mounted on the axis of the respective motor (45) and, having interposed a bearing (43), is supported by a corresponding panel (11). Moreover, one end of said clutch (40) is located, having interposed a relative bearing (44), within a bracket (5) which is integral with the skirt of a couple of parallel actuators (50), for example pneumatic cylinders, with the relative rods (51) being orthogonal to and integral with said panel (11), that is being parallel to said clutch (40). The other end of said clutch (40) is intended to be inserted into a corresponding grooved axial hole (22) in the end portion (21) of the respective embossing roll (2). In practice, when the rods (51) of the respective actuators (50) are extended, the corresponding body (40) is disconnected from the respective embossing roll (2), which is therefore separated from the relative motor (45). Vice versa, when the rods of the actuators (50) are retracted, the corresponding body (40) is inserted into the respective embossing roll (2) which is therefore set into rotation, with preset angular velocity, by the relative motor (45).

Preferably, said motors (45) and means of transmission (40) are all mounted on the same side of the structure (1) and are external to said sides (10).

The figures in the attached drawings also show a sizing unit (6), per se known to technicians of the field, and three rubber pressure rolls (7), per se also known to the technicians of the field, each one intended to cooperate, while in the operating position, with an embossing roll (2) by pressing the paper material (M, N) against the embossing roll as the paper is being fed through (with procedures per se also known to the technicians in the field). The embossing, in the strict sense, of the paper material (M, N) follows procedures per se known to the technicians of the field and, therefore, it is not described in further detail herein.

Figure 2:
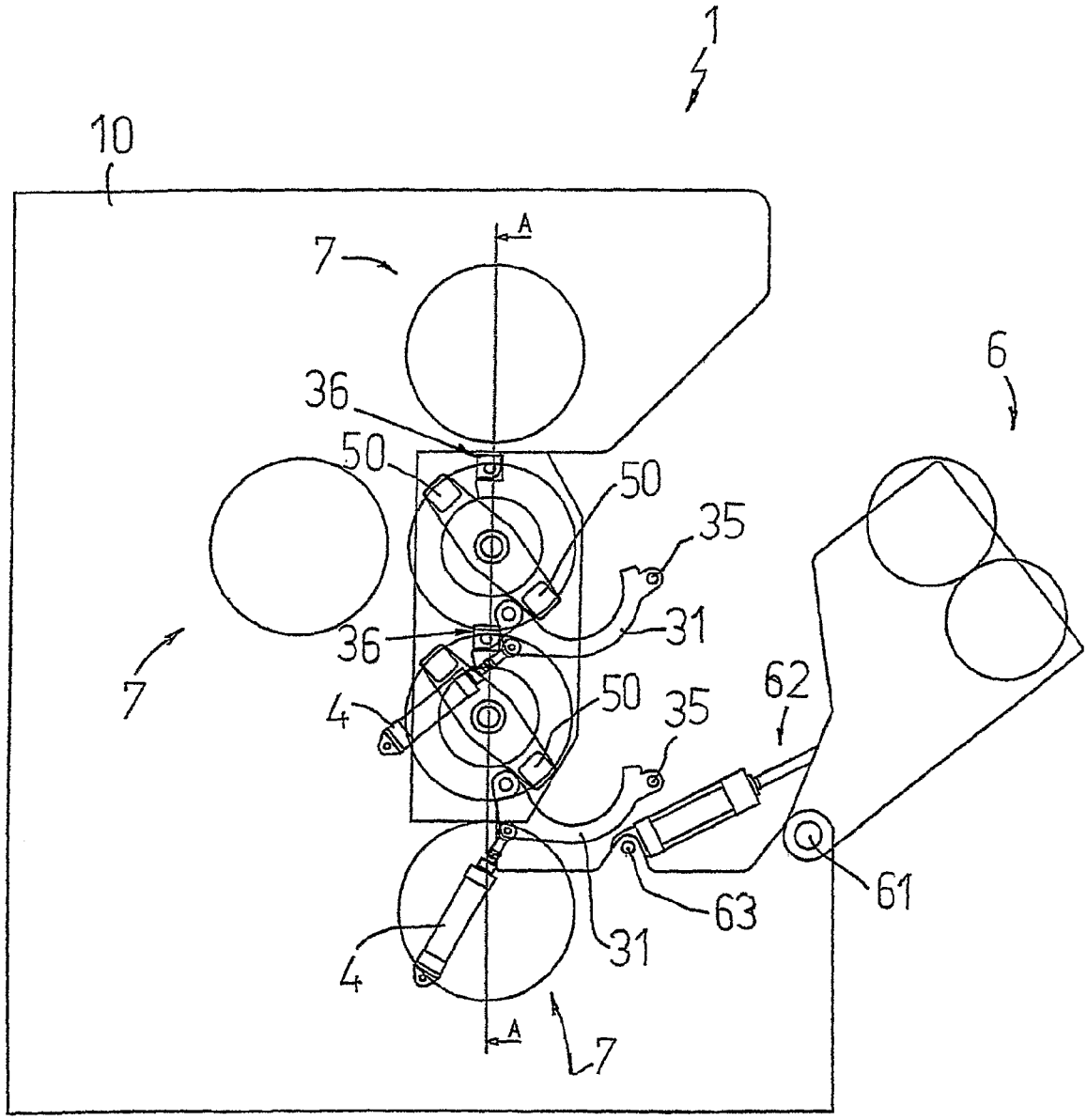
FIG. 2 is a view of the transmission side of the apparatus shown in FIG. 1.
Figure 3:
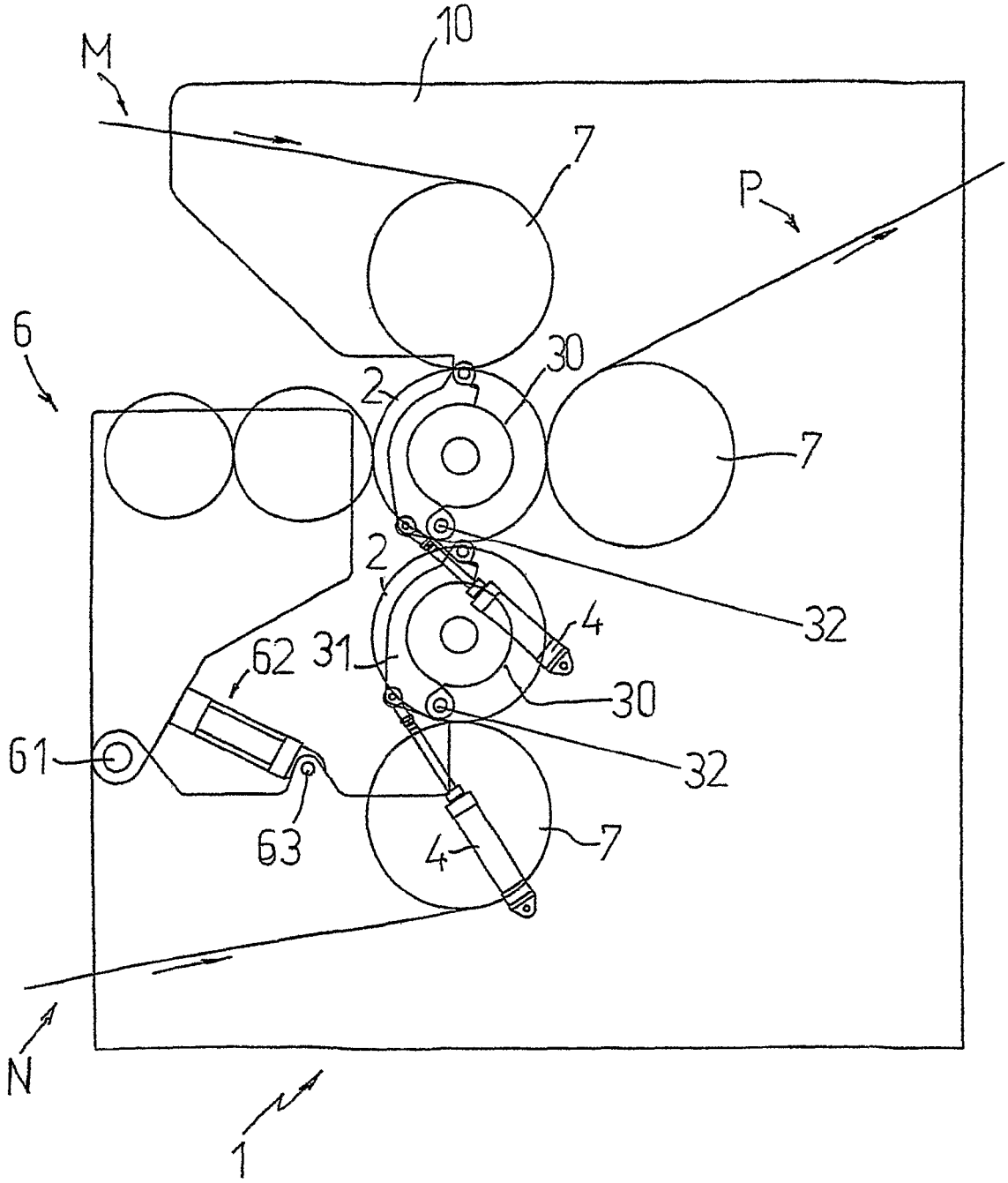
FIG. 3 represents the apparatus according to the invention in the operating position and shows the path of two paper plies (M, N) being embossed and the out-coming united ply (P)

Both the sizing unit (6) and said pressure rolls (7) are mounted onto corresponding mobile supports in order to be moved closer to the embossing rolls (2) in the operating position (as in FIG. 3) and, vice versa, to be distanced into the position for the replacement of one or more embossing rolls (as in FIG. 1 and FIG. 2). In detail, according to the embodiment shown in the attached drawings, the sizing unit (6) is mounted onto a support (60), which is made to pivot about a corresponding fixed axis (61) by means of two corresponding hydraulic cylinders (62): said axis (61) is parallel to the axes of the embossing rolls (2) and the skirt of each said cylinder (62) is attached to a corresponding side (10) of the fixed structure (1) by a hinge (63) having a horizontal axis. The pressure rolls (7) are mounted onto relative supports with linear sliding (70), per se known, and are controlled by corresponding actuators (for simplification, represented only in the diagram in FIG. 8 and referred to by the numeric reference 71). Said actuators (4, 35, 50, 62, 71) and said motors (45) are connected with a control device (for example, a programmable electronic unit UE) which allows automated management, as explained below in more detail. A programmable electronic unit of this kind is structured and configured according to methods known to the technicians of industrial automation and, therefore, it is not explained in any further detail herein.

Figure 4:
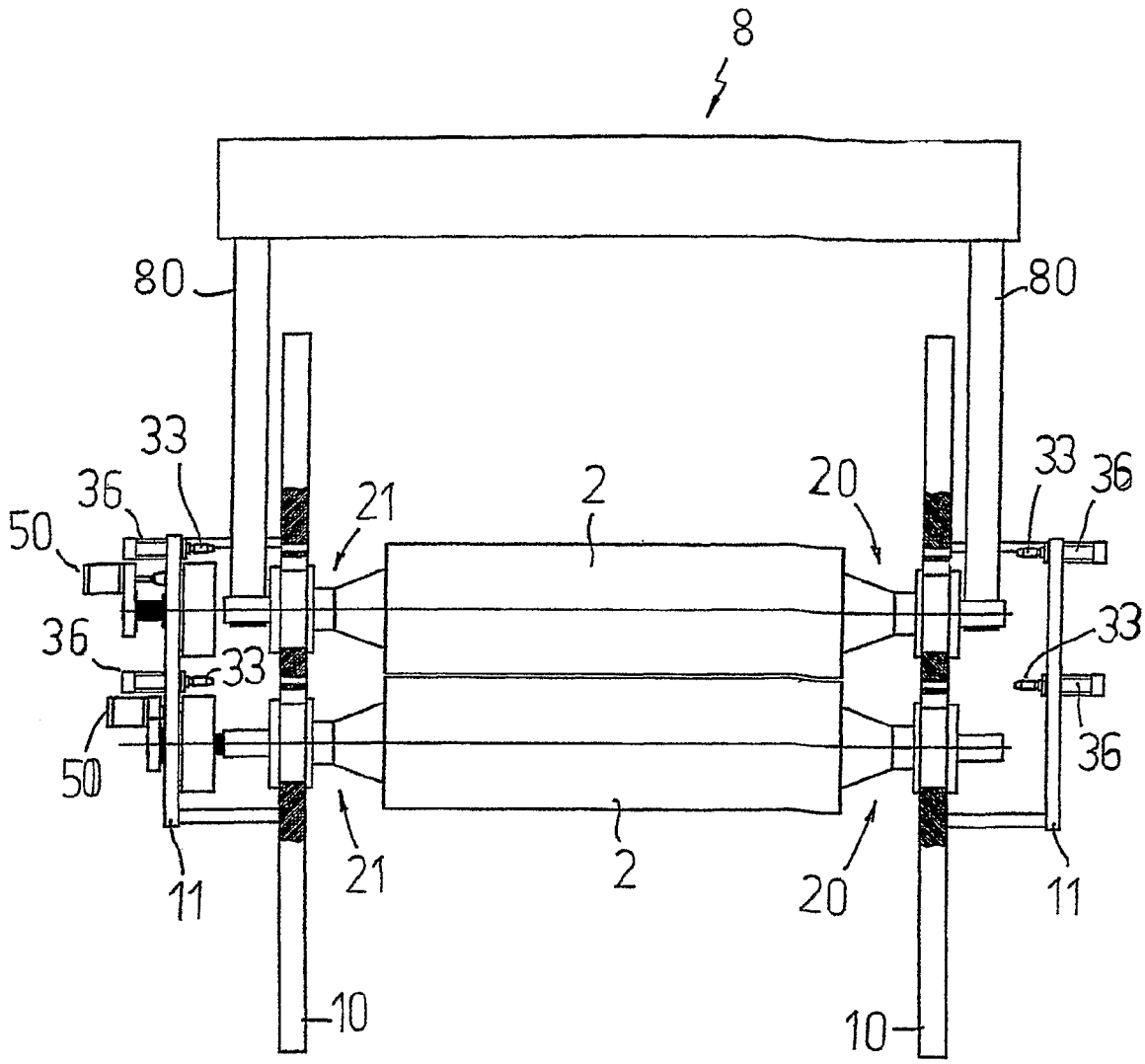
FIG. 4 is a schematic cross-section along the line A-A of FIG. 2.
Figure 5:
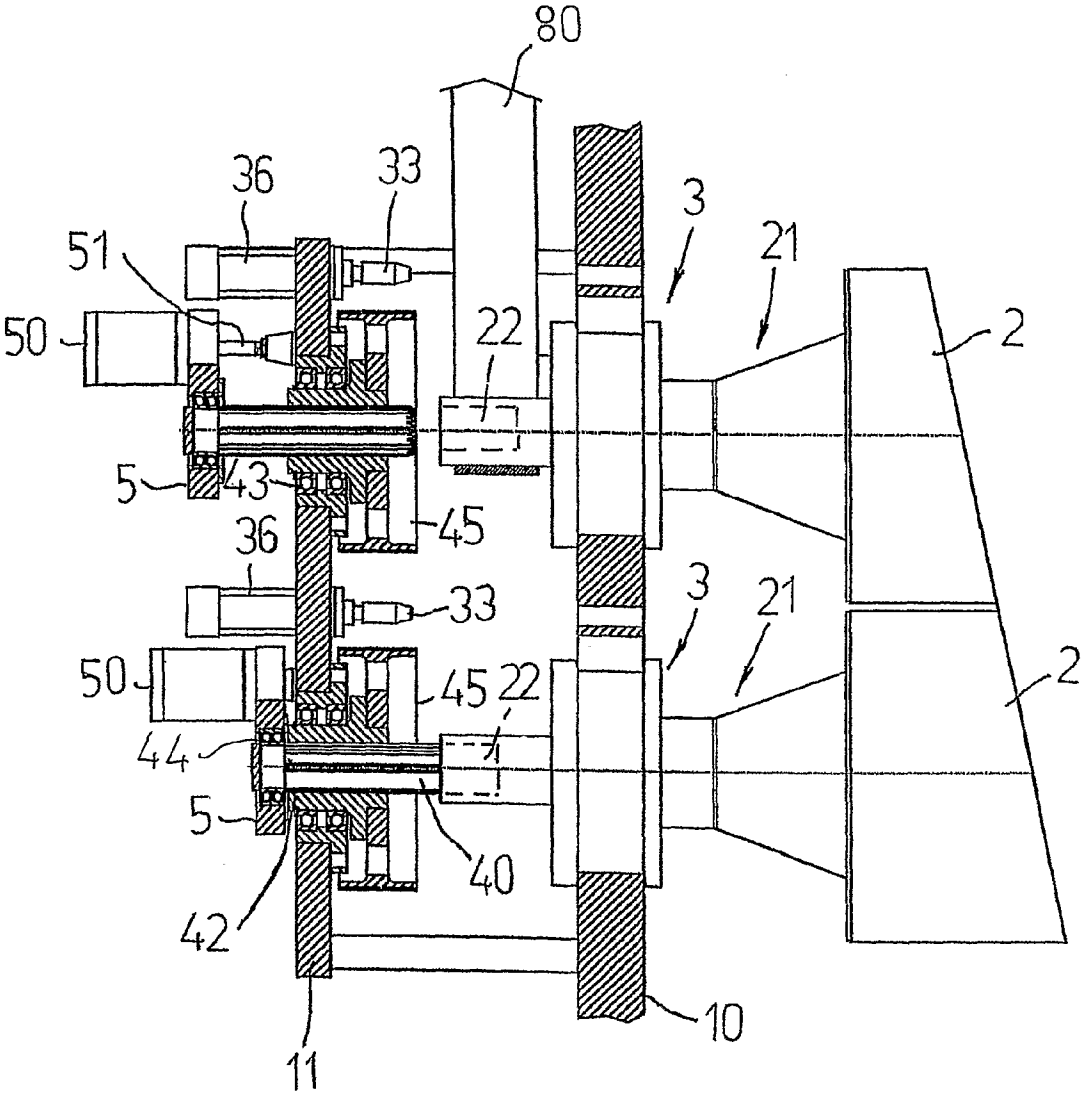
FIG. 5 is an enlarged detail of FIG. 4.
Figure 6:
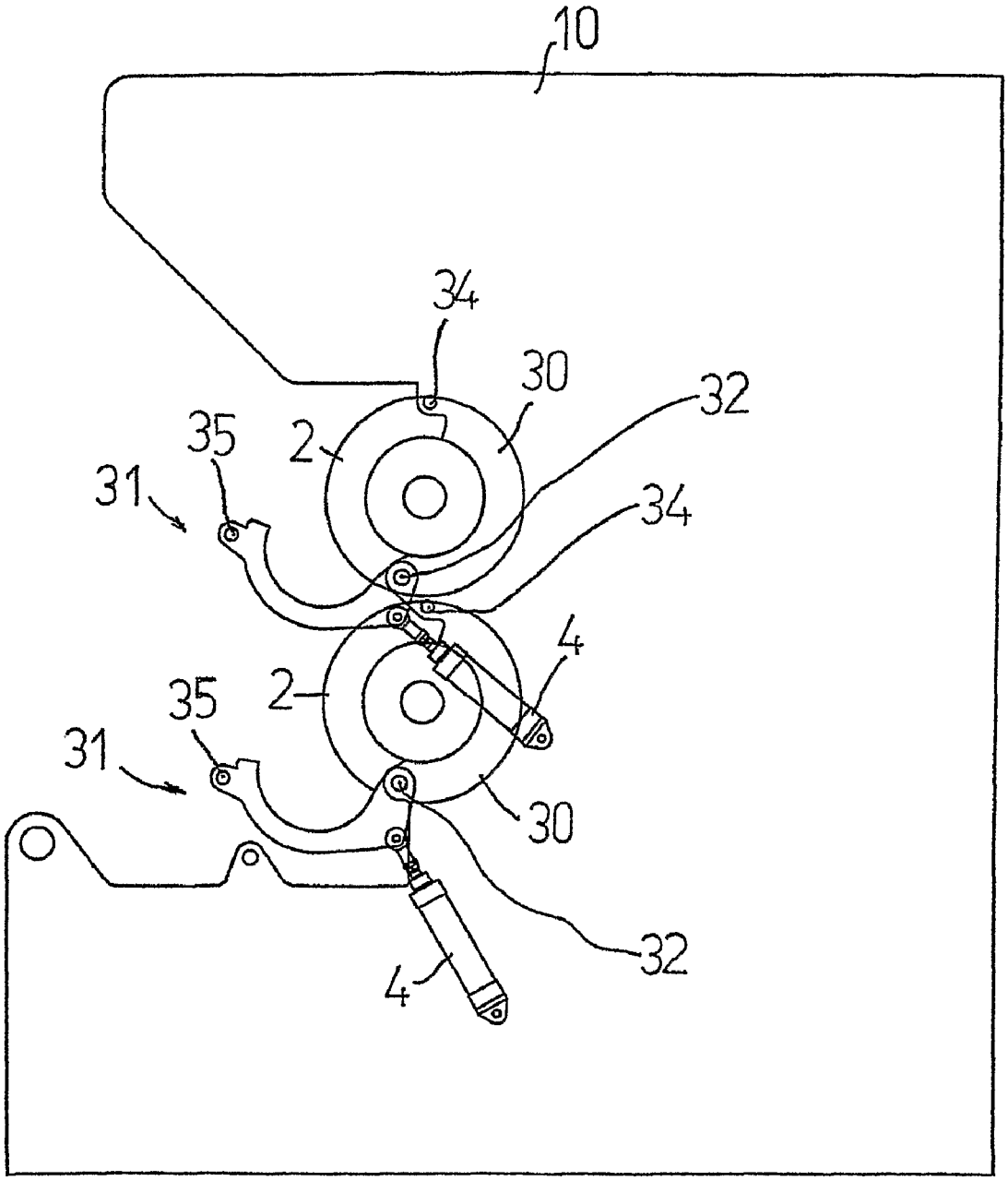
FIG. 6 is a simplified version of FIG. 1 where some parts are not represented so as to better illustrate others.
Figure 7:
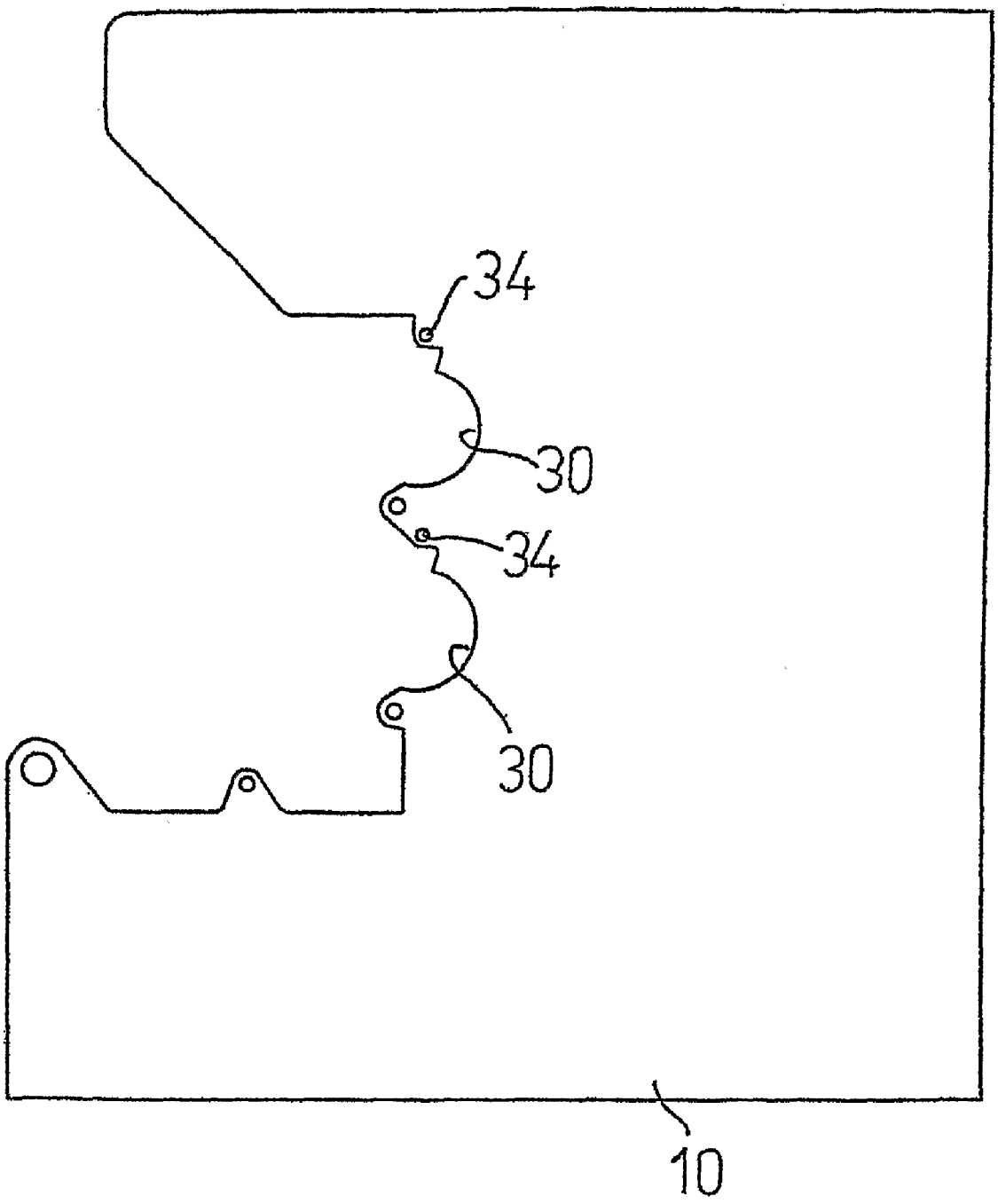
FIG. 7 is a side view of the structure side (10) from the operator side.
Figure 8:
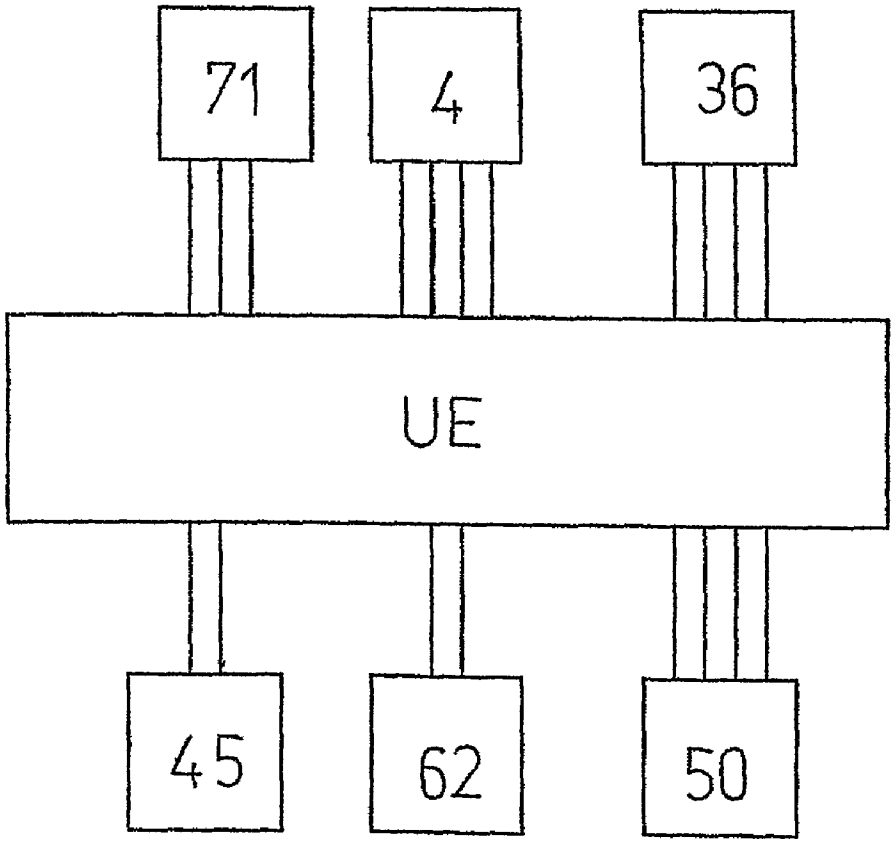
FIG. 8 is a simplified block diagram of the control system of the actuators.

In order to replace any one of the embossing rolls (2), the machine operator, by means of a keyboard (not shown), operates the unit (UE) which then controls the automatized distancing of the sizing unit (6) and of the pressure rolls (7), the disengagement of the respective transmission (40) and the opening of the relative collars (3). At this point, the embossing roll to be replaced is free and may be hooked by a crane bridge (8), then lifted and set down in a predetermined location external to the machine. The same bridge crane (8) hooks another embossing roll, previously deposited nearby the machine, and then deposits it in the place of the one that was previously removed. Once the replacement has been completed, the operator intervenes on the unit (UE) to activate a reverse operational sequence, with the closing of the collars (3) previously opened, the insertion of the transmission (40) and the approach of the sizing unit (6) and of the pressure rolls (7) to the embossing rolls (2). FIGS. 4 and 5 in the attached drawings show two belts (80) of the crane bridge which carry the end portions (20, 21) of the axis of an embossing roll (2).

Figure 9:
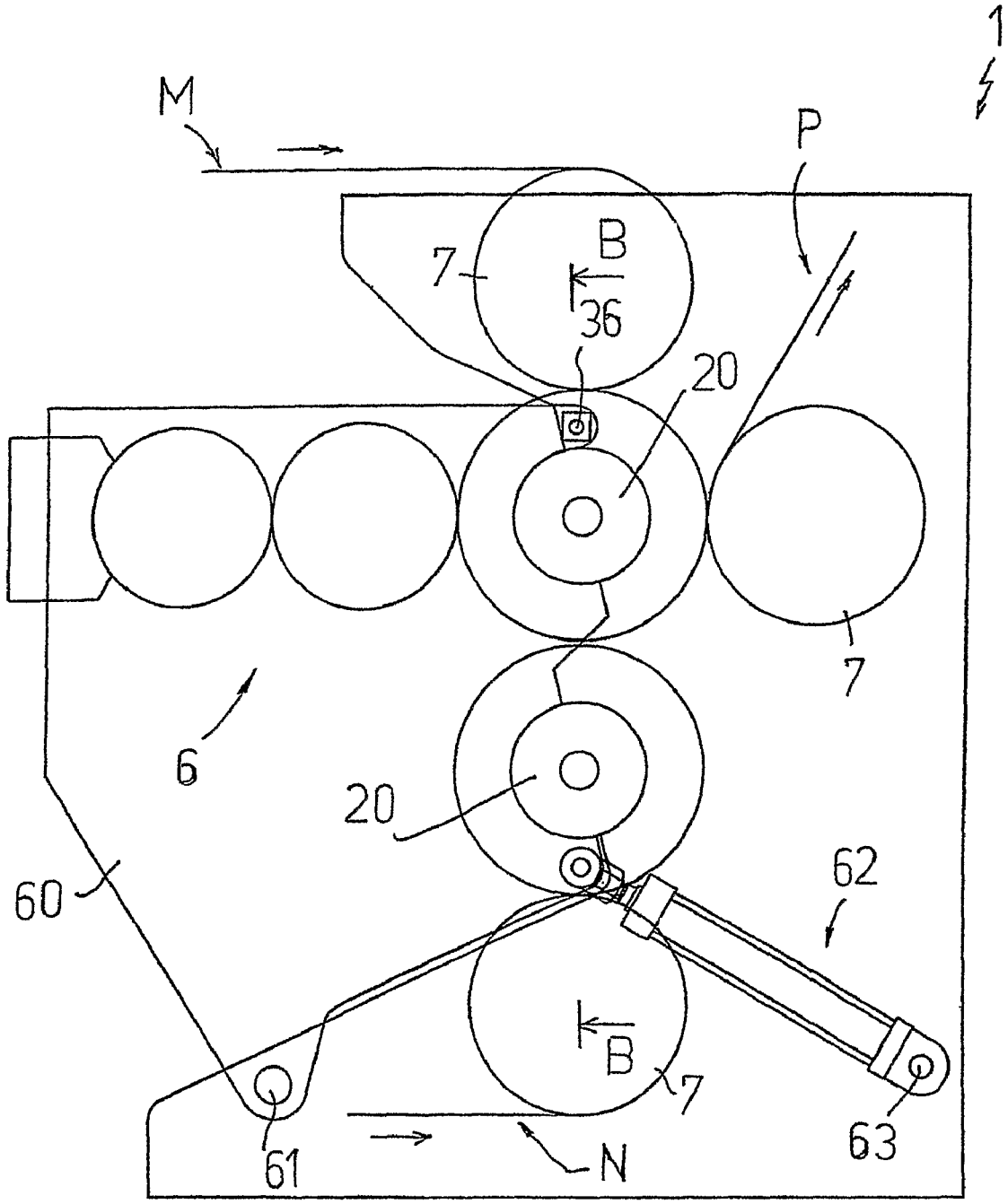
FIG. 9 is a schematic side view, from the operator side, of a support apparatus for embossing rolls according to a different embodiment of the present invention in the operating position.
Figure 10:
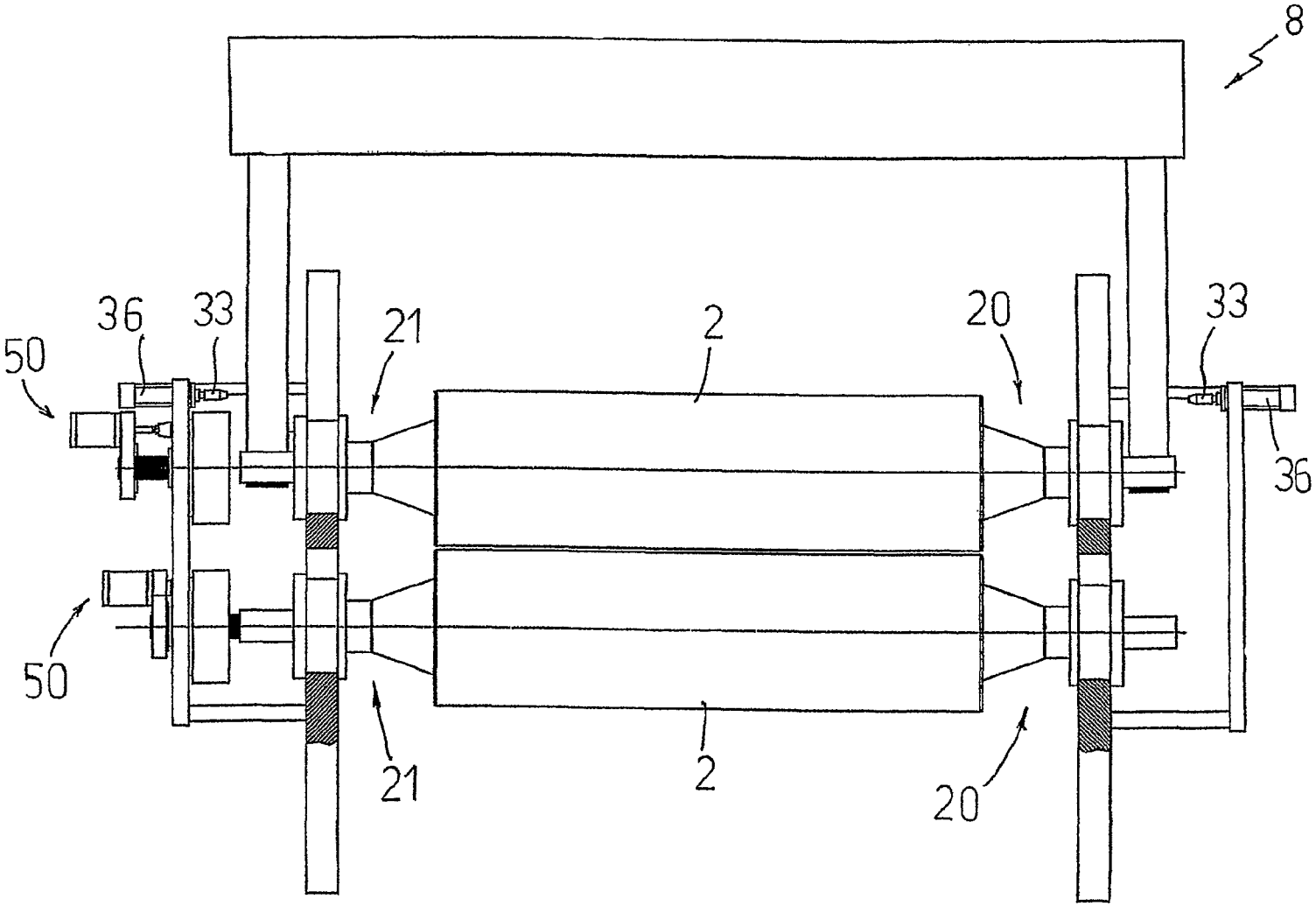
FIG. 10 is a schematic cross-section along the line B-B of FIG. 9.
Figure 11:
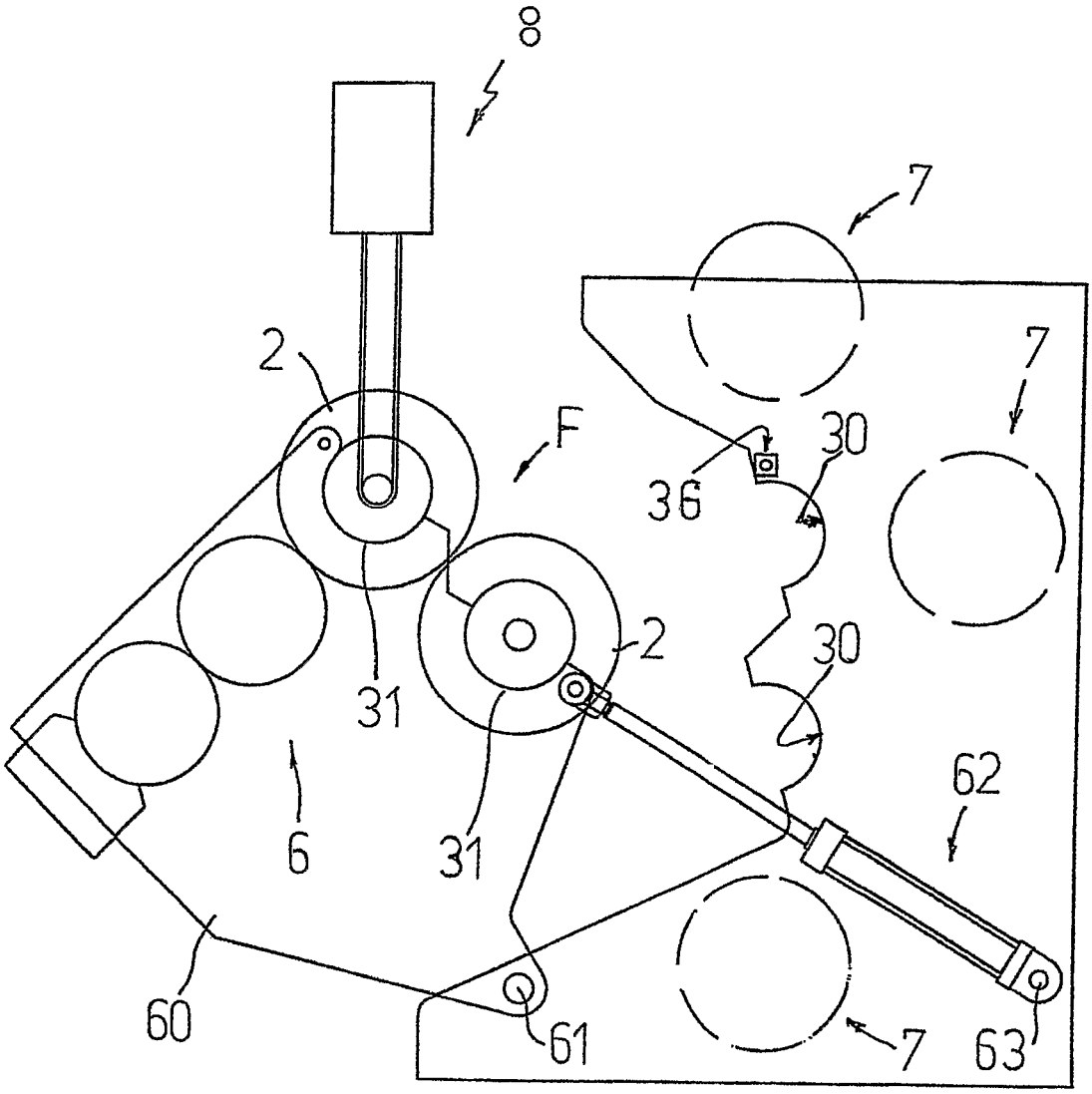
FIG. 11 represents the apparatus shown in FIG. 9 in the position for the possible replacement of the embossing rolls.

The embodiment shown in FIGS. 9-11 of the attached drawings differs from the one shown in FIGS. 1-8 in that the mobile element (31) of each collar (3) is made of a corresponding portion of the support (60) of the sizing unit (6). In detail, each mobile element (31) is made of a corresponding concave portion of said support (60) in correspondence of a front (F) facing the fixed sides (10) of the structure (1): the respective fixed element being made of a corresponding concave portion of the relative side (10). Therefore, when the actuator (62) is activated, the rotation of the support (60) around the axis (61) corresponds with the opening of the collars (3), meaning the distancing of the mobile elements (31) of the collars (3) from the corresponding fixed elements (30). And, since, in this case, the concave portions of the structure (60) forming the mobile elements (31) of the collars (3) have a greater angular extension compared to the corresponding concavities (30) defined on the sides (10), when said support (60) is rotated (as shown in FIG. 11), the embossing rolls (2) are automatically transferred from the operating position shown in FIG. 9 to a possible replacement position (FIG. 11) which is set at a preset distance from the operating position because the embossing rolls (2) are associated to the same structure (60) carrying the sizing unit (6).

Even in this case, before rotating the support (60) around the axis (61), the transmission must be disengaged and the pins (33) must be retracted.

Figure 12:
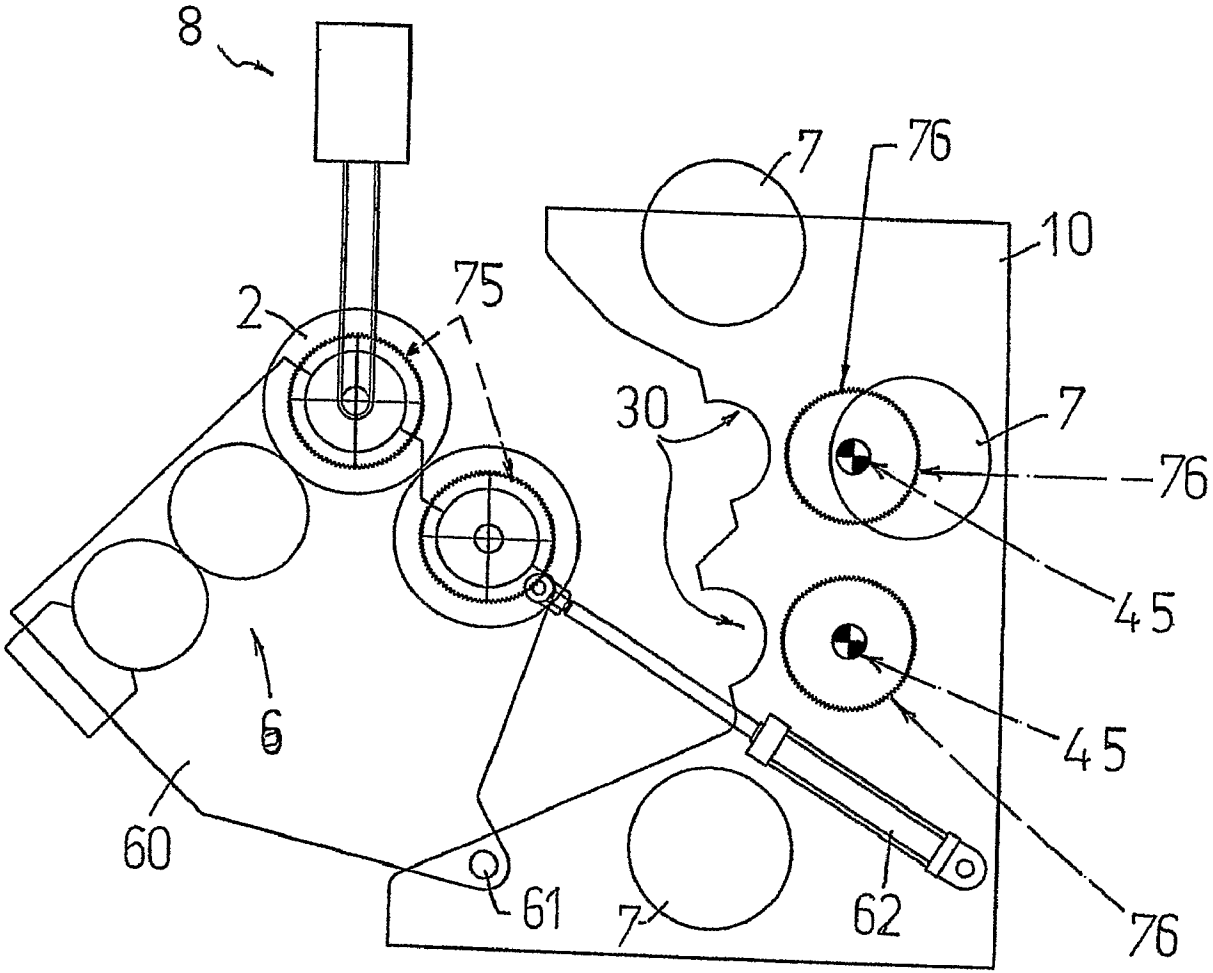
FIG. 12 is another the embodiment of the apparatus according to the invention in the position for the possible replacement of the embossing rolls.
Figure 13:
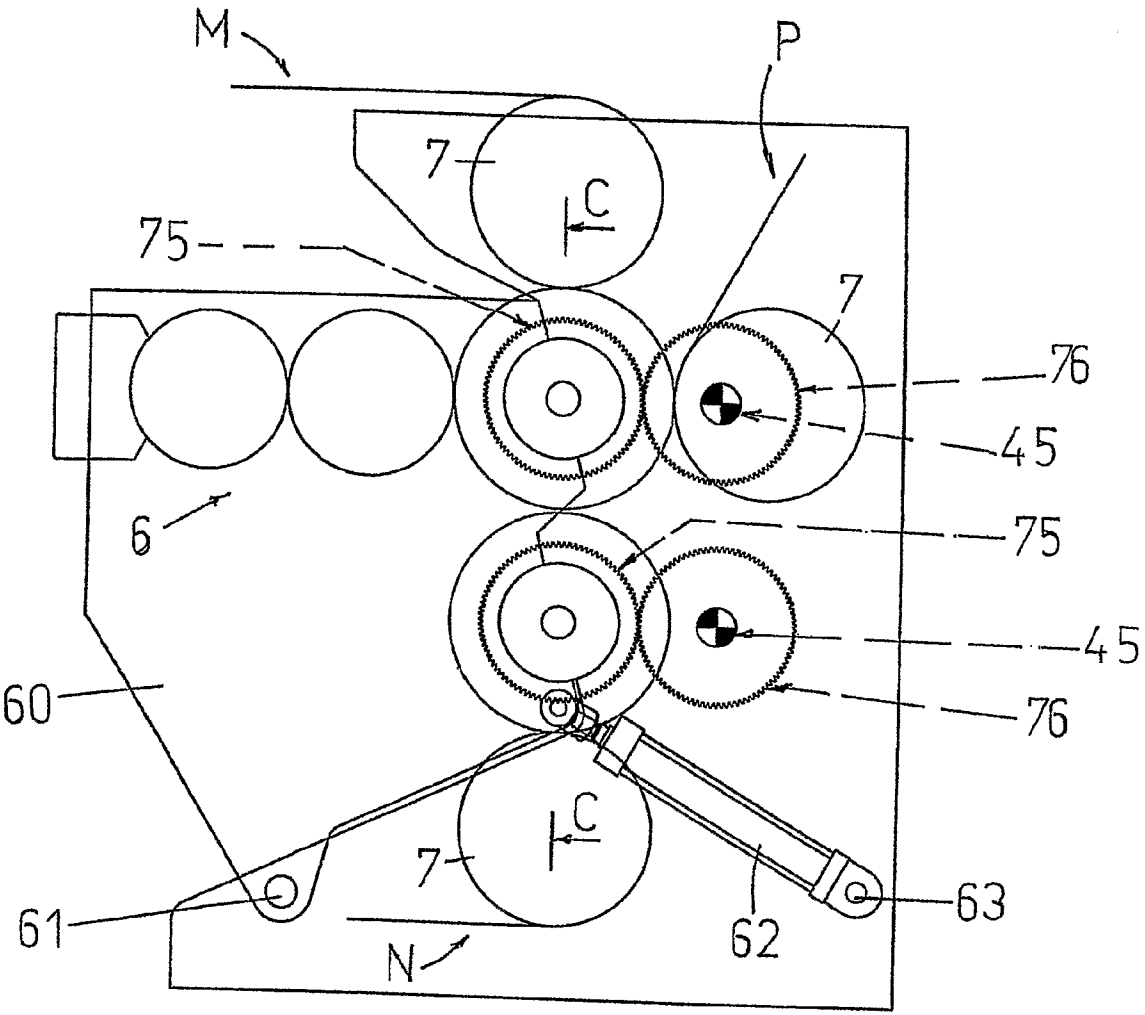
FIG. 13 represents the apparatus shown in FIG. 12 in the operating position.
Figure 14:
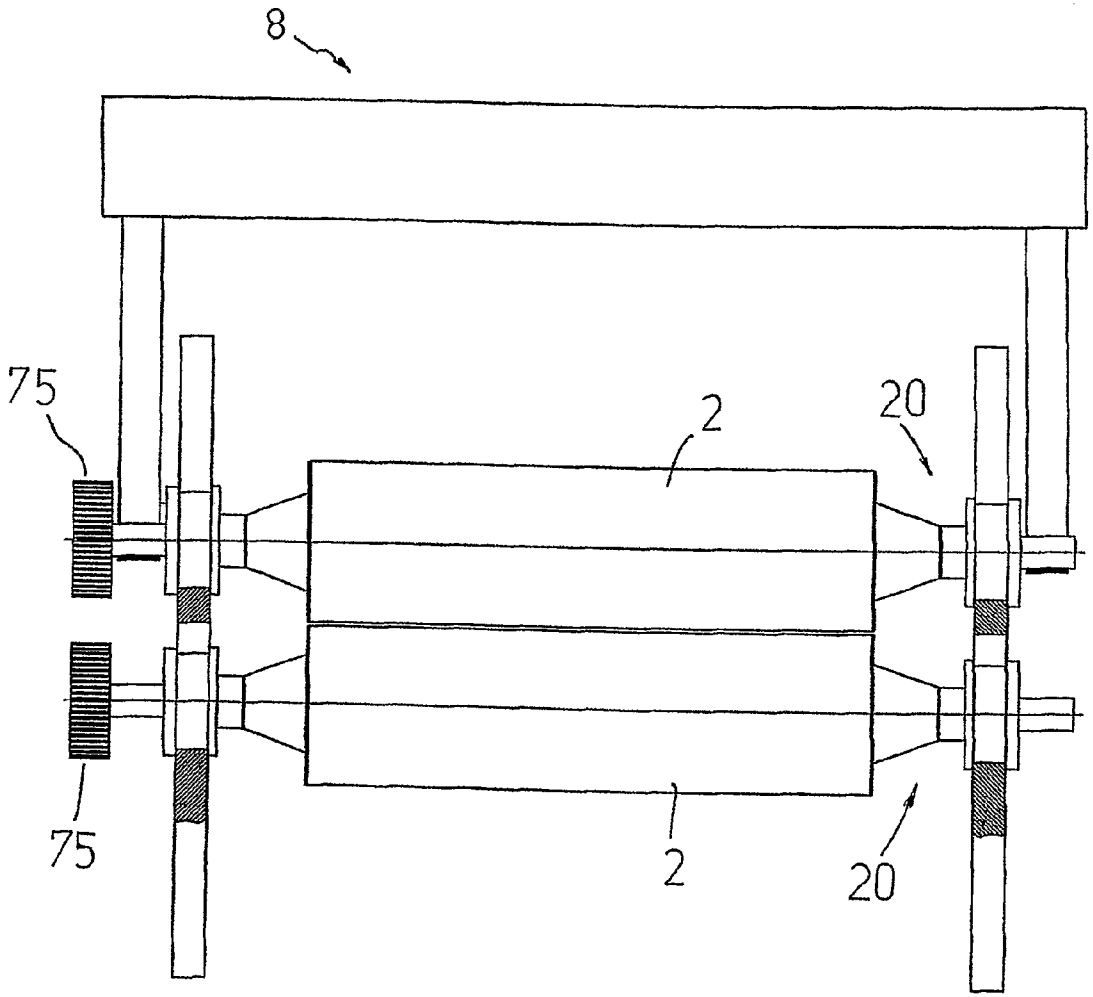
FIG. 14 is a schematic cross-section along the line C-C of FIG. 13.

The embodiment shown in FIGS. 12-14 in the attached drawings differs from the ones described above in the method by which the motors (45) move the embossing rolls (2). In more detail, a gear wheel (75), which, when the machine is in the operating position (FIG. 13), engages a corresponding gear wheel (76) set into rotation by the motor (45), is fitted onto the end portion (21) of each embossing roll (2). Because of this kind of connection between each roll (2) and the respective motor (45), it is no longer necessary to disengage a transmission in order to set the apparatus in the position for the possible replacement of the embossing rolls (FIG. 16).

Figure 15:
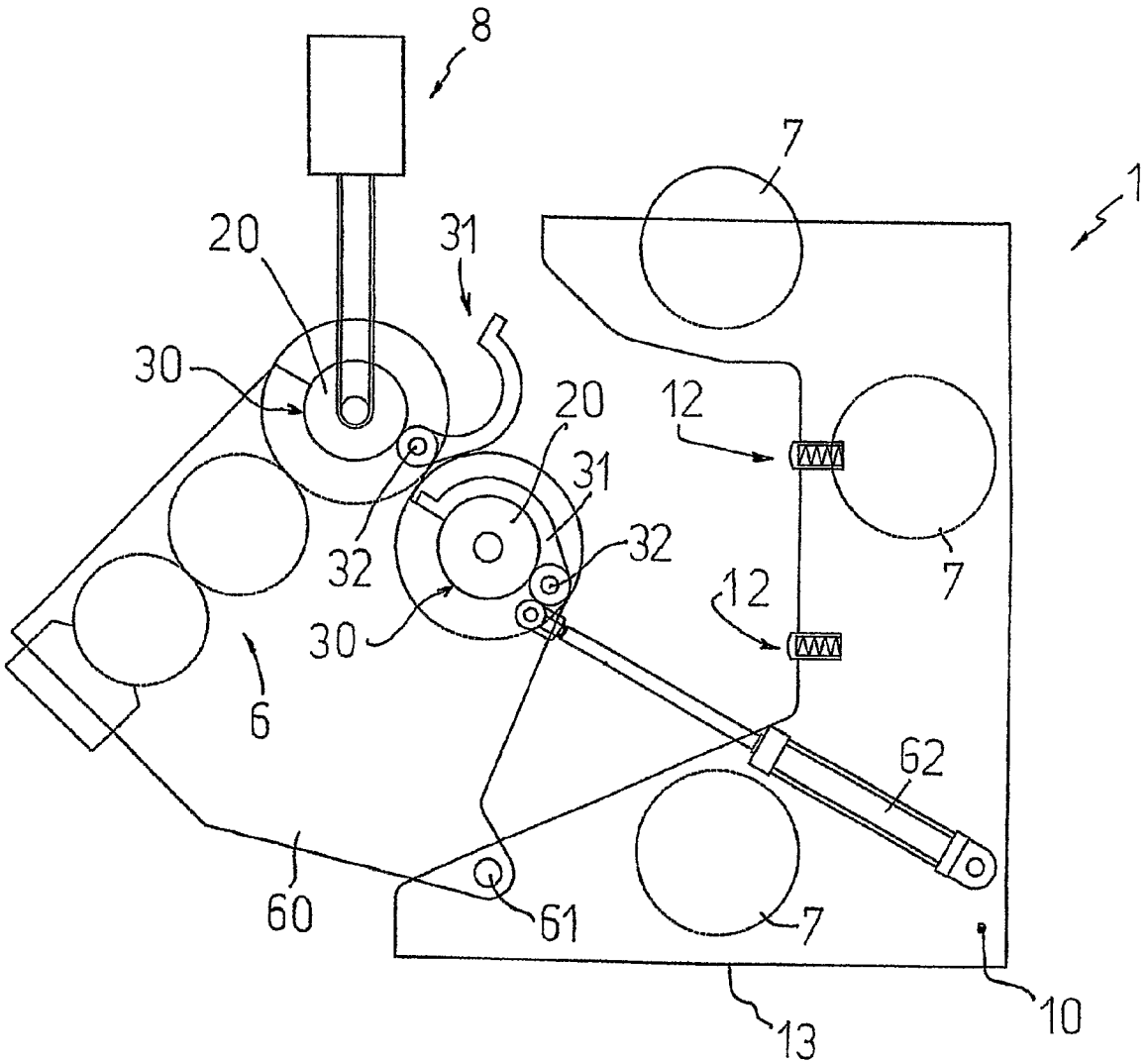
FIG. 15 is a schematic lateral view from the operator side in another embodiment of an apparatus according to the invention, in the position for the possible replacement of the embossing rolls.
Figure 16:
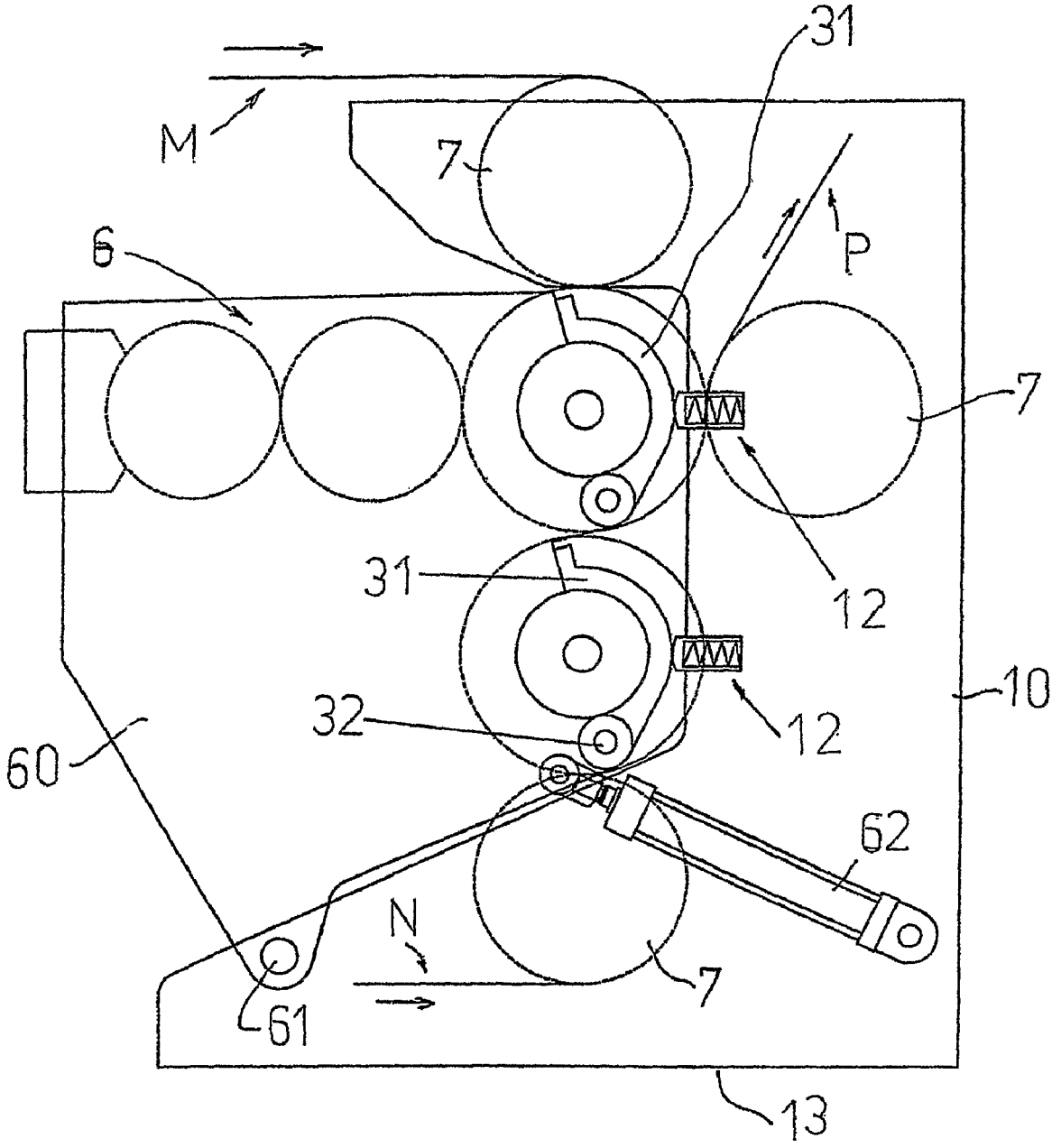
FIG. 16 represents the apparatus of FIG. 15 in the operating position.

The apparatus shown in FIGS. 15 and 16 differs from the one described above in that the positioning of the mobile elements (31) of the bearings (3) in closed asset is achieved indirectly (instead of directly, as in the previous examples) by means of actuators (62) which move said mobile structure (60). In more detail, the mobile element (31) of each bearing (3) is connected to the respective fixed element by means of a corresponding hinge (32) having a horizontal axis, that is, analogously to the example shown in FIGS. 1 and 3, having an axis parallel to the rotation axis of the embossing rolls (2). Nonetheless, in this case, said mobile element (31) is free to rotate around the axis of said hinge (32). Therefore, when the apparatus is in the position for the possible replacement of the embossing rolls (as shown in FIG. 15), the operator may manually rotate the elements (31) relative to the roll or rolls (2) to be replaced in order to open the corresponding bearings (3). And, once the replacement has been completed, by operating the retraction of the pin of the actuators (62), that is by setting the machine into the operating position (as shown in FIG. 16), the elements (31) are automatically positioned close to the respective fixed elements (30), having been intercepted by corresponding elastic beats (12) exhibited by the fixed sides (10). Said beats (12) are made of elastic bodies positioned at a preset height from the base plane (13) of the sides (10) and protruding from the front of the sides (10) facing the structure (60). In such way, the actuators (62) indirectly close the bearings (3) when the machine is set into the operating position.

Advantageously, the end portions (20, 21) of the embossing rolls (2) extend beyond the sides (10) of the structure (1), that is they are appropriately configured as to be able to be hooked by means of lifting and handling external to the machine (for example, the belts 80 of the bridge crane 8).

In the examples described above, each said bearing (3) is made of two elements (30, 31), one of which (30) is fixed, whereas the other one (31) is mobile. Said elements (30, 31) are concave so that, while the embossing device (the entirety of elements contributing to the embossing) is in the operating position, they jointly define a substantially circular space through which a corresponding end portion (20, 21) of an embossing roll (2) is made to pass.

In the position for the possible replacement of the embossing rolls (2), the concavities of said elements (30, 31) are distanced from one another, said space is open, and the rolls (2) are supported by fixed semi-supports (30) or by mobile ones (31). In this position, the rolls are supported by fixed semi-supports in a stable enough way to allow the safe continuation of operations. Moreover, the fixed semi-supports (30) are defined, as shown in the examples shown in the attached drawings, by corresponding concave portions of a fixed body (10), and the mobile semi-supports (31) can be connected (by means of a hinge 32 having a horizontal axis) to the fixed semi-supports (30).

Alternately, the mobile semi-supports (31) may be defined by corresponding concave portions of a mobile body (60), which also functions as support for the sizing unit (6) and is connected with relative handling means (62) which allow the distancing of said fixed body (10) when one or more embossing rolls (2) must be replaced (that is to allow the opening of said space defined by the fixed element and the corresponding mobile element of each collar 3) and, respectively, the approach of the fixed body (10) when the embossing device must be set into the operating position.

Moreover, in the presence of auxiliary members, for example a sizing unit and pressure rolls, the above components are distanced from the embossing rolls, thus creating a surrounding open space to ease the intervention of said lifting and handling means. As shown in FIGS. 1, 11 and 12 of the attached drawings, the removal of each roll (2) to be replaced also involves the handling of the same along a substantially vertical ascending trajectory (as in the case of the upper roll 2 in FIGS. 11 and 12) or along a substantially oblique trajectory, that is a trajectory substantially resulting from a combination of horizontal and vertical movements, which departs from the height of the respective longitudinal axis and ends in correspondence of an area or height where there is no interference with the structure (1). Each embossing roll that replaces an embossing roll (2) previously replaced follows the same trajectory, but in a descending direction. According to the examples shown in the attached drawings, said trajectory is developed between the sides (10) of the structure (1) and the front (F) of said support (60) facing the sides (10), that is in the space in front of the sides (10). In order to set the machine into the position for the possible replacement of the rolls and then into the operating position, the operator must simply activate said actuators (4, 62) with which the mobile elements (31) of the bearings (3) are directly or indirectly connected.

A method for the replacement of one or more embossing rolls (2) positioned between the two sides (10) of a support structure (1) with the respective end portions (20, 21) on corresponding bearings (3), according to the invention, comprises the step of opening of a space surrounding the roll or rolls to be replaced and the step of removal of the roll or rolls from the respective supports. Said removal step is preceded by the disengagement of said end portions (20, 21) by opening the respective bearings (3) and involves the handling of the rolls (2) along a substantially vertical or oblique ascending trajectory developed in the space in front of the sides (10).

Advantageously, said opening of the bearings (3) may be operated by a command given by the machine operator: said bearings (3) being connected with corresponding actuators which dispose the same bearings (3) into an open or closed position around the end portions (20, 21) of the rolls (2), the actuators being operated by said command.

The method and machine described above result particularly advantageous in that the bridge crane (8) is always available, being regularly used for the handling of the logs from which the paper plies to be embossed are unwound, in that the machine operator is already qualified and trained to use the bridge crane, and in that the steps of releasing the embossing rolls to be replaced and repositioning of the new rolls into the operating position are fully automated and require greatly reduced times.

Practically, the construction details may vary in any equivalent way as far as the shape, dimension, disposition of elements and materials used are concerned, without nevertheless departing from the scope of the adopted solution idea and, thereby, remaining within the limits of protection granted to the present patent for industrial invention.

The invention claimed is:

1. A support apparatus comprising:

a fixed structure with two sides;

a mobile part with two sides, said mobile part being pivotably connected to said fixed structure;

a first embossing roll with end portions;

a second embossing roll with end portions;

a first motor;

a second motor;

a first collar support providing a bearing seat for supporting an end portion of said first embossing roll, said first collar support providing a collar coaxial with and external to an axis of said first embossing roll and comprising a first fixed collar surface and a first mobile collar surface;

a second collar support providing a bearing seat for supporting an end portion of said second embossing roll, said second collar support providing a collar coaxial with and external to an axis of said second embossing roll and comprising a second fixed collar surface and a second mobile collar surface, said first collar support and said second collar support comprising one of:

said first mobile collar surface and said second mobile collar surface each comprising a surface of said mobile part pivotably connected to said fixed structure with said first fixed collar surface and said second fixed collar surface each comprising a surface of the side of said fixed structure;

said first mobile collar surface and said second mobile collar surface each comprising an additional element pivotably connected to said fixed structure and said first fixed collar surface and said second fixed collar surface each comprising a surface of the side of said fixed structure; or said first mobile collar surface and said second mobile collar surface each comprising an additional element pivotably connected to said mobile part and said first fixed collar surface and said second fixed collar surface each comprising a side of said mobile part, said first mobile collar surface and said second mobile collar surface providing a collar surface that is between a closed position for closing said first collar support and second collar support and an open position for opening of said first collar support and said second collar support, said first collar support and said second collar support being associated with one of said two sides and cooperating with another first collar support and another second collar support of the other of said two sides to support a respective embossing roll with a horizontal axes extending between the two sides to retain said first embossing roll and said second embossing roll with said mobile part pivoted to an operative closed position and said first embossing roll and said second embossing roll only being removable with said mobile part pivoted away from said fixed part into an open position, one of said end portions of said first embossing roll being connected to said first motor, in said operative closed position, for rotation by said first motor around said first embossing roll axes at a preset angular velocity and with one of said end portions of said second embossing roll connected to said second motor, in said operative closed position, for rotation by said second motor around the axes of said second embossing roll at a preset angular velocity;

an actuator; and a control device, said actuator being controlled by said control device based on electronic control signals of said control device for moving said mobile part through a pivoting course between the operative closed position to retain said first embossing roll and said second embossing roll and the open position.

2. A support apparatus according to claim 1, further comprising:

motor disconnection and connection transmission means for mechanically operated and axially directed connecting and disconnecting one of said end portions of said first embossing roll to and from said first motor and axially directed connecting and disconnecting one of said end portions of said second embossing roll to and from said second motor, said disconnection and connection transmission means being controlled by said control device with said disconnection and connection transmission means providing a connection of said end portions of the respective said embossing rolls to the respective said motor and providing a disconnection of said end portions of the respective said embossing rolls from the respective said motor based on electronic control signals of said control device.

3. A support apparatus according to claim 2, wherein: said motor disconnection means includes, in correspondence to each of said one of said end portions of said first embossing roll and said one of said end portions of said second embossing roll, a clutch connected with a respective clutch actuator to connect said first embossing roll to said first motor and to connect said second embossing roll to said second motor in the operative closed position and to disconnect said first embossing roll from said first motor and to disconnect said second embossing roll from said second motor in the open position, said actuator being controlled by a program of said control device.

4. A support apparatus according to claim 3, wherein: said clutch connected with a respective actuator moves axially to connect the roll to the relative motor in the operating position and moves axially to disconnect the roll from the relative motor to remove the roll from the corresponding supports.

5. The support apparatus of claim 3, wherein the clutch is made of a grooved body for insertion into a correspondingly grooved hole in said one of said end portions of said first embossing roll and said one of said end portions of said second embossing roll, with said clutch provided on a side of said fixed structure or said mobile part.

6. The support apparatus of claim 1, wherein the axis of each embossing roll protrudes by a preset length from said sides of said fixed structure or said mobile part to define hooking regions to be hooked by a lifting and handling means.

7. The support apparatus of claim 1, wherein said first mobile collar surface and said second mobile collar surface each comprise said additional element pivotably connected to said fixed structure and said first fixed collar surface and said second fixed collar surface each comprise said surface of the side of said fixed structure and further comprising:

a first additional element actuator connected to said fixed structure and to said first mobile collar surface additional element for pivoting said first mobile collar surface additional element; and a second additional element actuator connected to said fixed structure and to said second mobile collar surface additional element for pivoting said second mobile collar surface additional element.

* * * * *